US008900013B2

(12) United States Patent
Li et al.

(10) Patent No.: US 8,900,013 B2
(45) Date of Patent: Dec. 2, 2014

(54) USB CONNECTOR HAVING AN INNER CIRCUIT BOARD FOR CONNECTING CABLES AND CONTACTS

(71) Applicant: Shenzhen Luxshare Precision Industry Co., Ltd., Shenzhen (CN)

(72) Inventors: Bin Li, Kunshan (CN); Wei-Ya Cheng, Kunshan (CN)

(73) Assignee: Shenzhen Luxshare Precision Industry Co., Ltd., Shenzhen, Guangdong Province (CN)

( * ) Notice: Subject to any disclaimer, the term of this patent is extended or adjusted under 35 U.S.C. 154(b) by 220 days.

(21) Appl. No.: 13/662,470

(22) Filed: Oct. 27, 2012

(65) Prior Publication Data

US 2013/0109242 A1 May 2, 2013

(30) Foreign Application Priority Data

Oct. 27, 2011 (CN) ..... 2011 2 0416252 U
Oct. 27, 2011 (CN) ..... 2011 2 0416262 U
Oct. 31, 2011 (CN) ..... 2011 2 0421160 U

(51) Int. Cl.
*H01R 24/00* (2011.01)
*H01R 13/66* (2006.01)
*H01R 12/53* (2011.01)
*H01R 24/62* (2011.01)

(52) U.S. Cl.
CPC ..... *H01R 12/53* (2013.01); *H01R 24/62* (2013.01); *H01R 13/6658* (2013.01)
USPC ..... 439/660

(58) Field of Classification Search
USPC ..... 439/660, 55
See application file for complete search history.

(56) References Cited

U.S. PATENT DOCUMENTS

| | | | | |
|---|---|---|---|---|
| 7,354,314 | B1 * | 4/2008 | Sprouse et al. | 439/660 |
| 7,440,287 | B1 * | 10/2008 | Ni et al. | 361/752 |
| 8,021,166 | B1 * | 9/2011 | Nguyen et al. | 439/76.1 |
| 8,297,987 | B2 * | 10/2012 | Nguyen et al. | 439/76.1 |
| 2008/0218799 | A1 * | 9/2008 | Hiew et al. | 358/1.16 |
| 2011/0201215 | A1 * | 8/2011 | Matsubara et al. | 439/55 |
| 2011/0300724 | A1 * | 12/2011 | Nguyen et al. | 439/76.1 |
| 2012/0008268 | A1 * | 1/2012 | Jiang et al. | 361/679.4 |
| 2012/0071032 | A1 * | 3/2012 | Tsai | 439/660 |

* cited by examiner

*Primary Examiner* — Chandrika Prasad
(74) *Attorney, Agent, or Firm* — Cheng-Ju Chiang

(57) ABSTRACT

A cable connector compatible to USB 3.0 standard includes an insulative housing having, a number of contacts and an inner circuit board for establishing electrically connection between the contacts and cables. The contacts are divided into a first contact group including a number of first contacts and a second contact group including a number of second contacts. The inner circuit board includes a first soldering area having a number of separated first pads connected to the first and the second contacts. The first pads include a first grounding pad connected to a grounding contact of the second contacts. The second soldering area includes a number of separated second pads connected to the cables. At least two adjacent or separated second pads are electrically connected to the first grounding pad for improving high frequency characteristics.

20 Claims, 16 Drawing Sheets

USB CONNECTOR HAVING AN INNER CIRCUIT BOARD FOR CONNECTING CABLES AND CONTACTS

BACKGROUND OF THE INVENTION

1. Field of the Invention

The present invention relates to a cable connector, and more particularly, to a cable connector compatible to USB 3.0 standard and having inner circuit board to establish electrical connection between contacts and cables.

2. Description of Related Art

On November 2008, a new generation of USB 3.0 (super high-speed USB) enacted by industry-leading corporations including Intel, Microsoft, HP, TI, NEC and ST-NXP etc. was released. The USB 3.0 standard provides transmission speed 10 times quicker than the USB 2.0 standard and has higher energy efficiency so that the USB 3.0 standard can be applied in PC peripheral devices and consumer electronics.

The development of the USB (Universal Serial Bus) standards is as follows: the first version, known as USB 1.0, was released on 1996 and its transmission speed is only up to 1.5 Mb/s; two years later, the USB 1.0 was upgraded to USB 1.1 with its transmission speed to 12 Mb/s; on April 2000, current widely used USB 2.0 was released with its transmission speed up to 480 Mb/s; however, the speed of USB 2.0 cannot meet the requirements of actual use anymore and under this condition, the USB 3.0 was pushed forward and the maximum transmission speed thereof is up to 5.0 Gb/s.

The USB 3.0 standard (or specification) defines type-A receptacle and plug and the type-A USB 3.0 plug is compatible to USB 2.0 receptacle. Comparing with the preceding generation of type-A USB 2.0 plug, the type-A USB 3.0 plug newly adds five elastic contacts and totally has nine contacts. The newly added five contacts include two pairs of high-speed differential signal contacts and a grounding contact therebetween. The afore-mentioned nine contacts extend to a rear end of an insulative housing for being soldered to cables. Since the space of the insulative housing is very limited, normally, directly soldering the nine contacts with the cables is difficult. Besides, before the soldering process, the cables should be aligned with the soldering sections. Under this condition, it is possible that the cables get warped which is harmful to improve product efficiency and reduce cost.

Hence, a cable connector with improved arrangement of soldering is desired.

BRIEF SUMMARY OF THE INVENTION

The present invention provides a cable connector compatible to Micro USB 3.0 standard. The cable connector includes an insulative housing, a plurality of contacts retained in the insulative housing, an inner circuit board connected to the contacts, and a metallic shell enclosing the insulative housing. The insulative housing includes a first tongue and a second tongue narrower than the first tongue. The contacts are divided into a first contact group fixed to the first tongue and a second contact group fixed to the second tongue. The first contact group includes a plurality of first contacts each of which comprises a first contacting section extending beyond the first tongue, a first retaining section fixed in the insulative housing and a first soldering section extending from the first retaining section. The second contact group includes a plurality of second contacts each of which comprises a second contacting section protruding upwardly beyond the second tongue, a second retaining section fixed in the insulative housing and a second soldering section extending from the second retaining section. The second contacts include a first pair of high-speed differential signal contacts, a second pair of high-speed differential signal contacts and a grounding contact disposed between the first pair and the second pair of high-speed differential signal contacts. The inner circuit board includes a first soldering area and a second soldering area opposite to the first soldering area. The first soldering area includes a plurality of separated first pads electrically and mechanically connected to the first soldering sections and the second soldering sections. The first pads include a first grounding pad connected to the second soldering section of the grounding contact. The second soldering area includes a plurality of separated second pads for being connected to cables so as to establish electrical connections between the contacts and the cables. At least two adjacent second pads are electrically connected to the first grounding pad.

The present invention provides a cable connector compatible to Micro USB 3.0 standard. The cable connector includes an insulative housing, a plurality of contacts retained in the insulative housing, an inner circuit board connected to the contacts, and a metallic shell enclosing the insulative housing. The insulative housing includes a first tongue and a second tongue narrower than the first tongue. The contacts are divided into a first contact group fixed to the first tongue and a second contact group fixed to the second tongue. The first contact group includes a plurality of first contacts each of which comprises a first contacting section extending beyond the first tongue, a first retaining section fixed in the insulative housing and a first soldering section extending from the first retaining section. The second contact group includes a plurality of second contacts each of which comprises a second contacting section protruding upwardly beyond the second tongue, a second retaining section fixed in the insulative housing and a second soldering section extending from the second retaining section. The second contacts include a first pair of high-speed differential signal contacts, a second pair of high-speed differential signal contacts and a grounding contact disposed between the first pair and the second pair of high-speed differential signal contacts. The inner circuit board includes a first soldering area and a second soldering area opposite to the first soldering area. The first soldering area includes a plurality of separated first pads electrically and mechanically connected to the first soldering sections and the second soldering sections. The first pads include a first grounding pad connected to the second soldering section of the grounding contact. The second soldering area includes a plurality of separated second pads for being connected to cables so as to establish electrical connections between the contacts and the cables. The second pads include a unitary second grounding pad electrically connected to the first grounding pad and the second grounding pad is much wider than its adjacent second pads.

The present invention provides a cable connector compatible to type-A USB 3.0 standard. The cable connector includes an insulative housing, a plurality of contacts retained in the insulative housing and an inner circuit board connected to the contacts. The insulative housing includes a tongue plate defining a mating portion. The contacts are divided into a first contact group and a second contact group. The first contact group includes a plurality of first contacts each of which comprises a flat first contacting section extending onto the mating portion, a first retaining section fixed in the insulative housing and a first soldering section extending from the first retaining section. The first contacts include a power contact, a first signal contact, a second signal contact and a first grounding contact. The second contact group includes a plurality of second contacts each of which comprises a resilient second contacting section protruding upwardly beyond the first contacting sections, a second retaining section fixed in the insulative housing and a second soldering section extending from the second retaining section. The second contacts include a first pair of high-speed differential signal contacts, a second pair of high-speed differential signal contacts and a second grounding contact disposed between the first pair and the second pair of high-speed differential signal contacts. The inner circuit board includes a first soldering area and a second soldering area opposite to the first soldering area. The first soldering area includes a plurality of separated first pads electrically and mechanically connected to the first soldering sections and the second soldering sections. The first pads include a first grounding pad connected to the second soldering section of the second grounding contact. The second soldering area includes a plurality of separated second pads for being connected to cables so as to establish electrical connections between the contacts and the cables. The second pads include at least two second grounding pads separated from each other in physical location while both electrically connected to the first grounding pad in electrical property. As a result, first and the second soldering sections and the cables can be easily and simultaneously soldered to the inner circuit board for improving assembling efficiency. Besides, high frequency characteristics of signal transmission of the cable connector can also be greatly improved.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
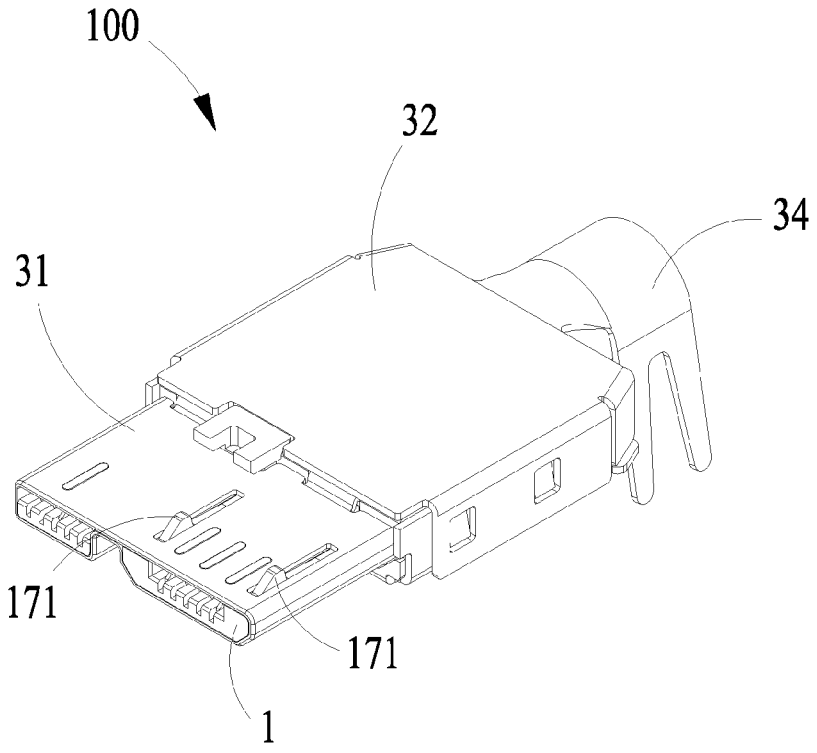
FIG. 1 is a perspective view of a cable connector in accordance with a first illustrated embodiment of the present invention.
Figure 2:
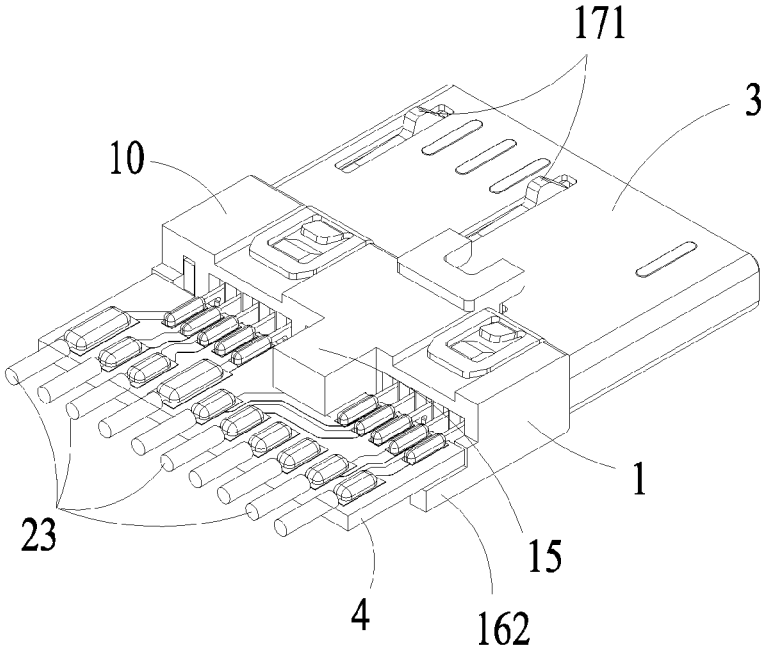
FIG. 2 is a partly exploded view of the cable connector as shown in FIG. 1 with a rear shell removed therefrom.
Figure 3:
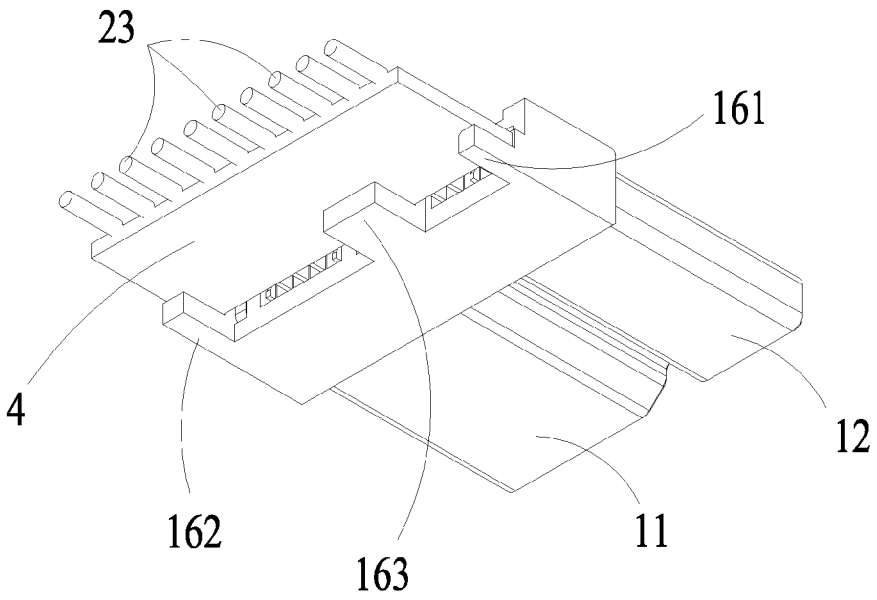
FIG. 3 is another partly exploded view of the cable connector as shown in FIG. 2, while taken from a different aspect.

Reference will now be made to the drawing figures to describe the embodiments of the present invention in detail. In the following description, the same drawing reference numerals are used for the same elements in different drawings.

Referring to FIGS. 1 to 5, according to a first illustrated embodiment, the present invention discloses a cable connector 100 compatible to Micro USB 3.0 standard. The cable connector 100 includes an insulative housing 1, a plurality of contacts 2 retained in the insulative housing 1, a metallic shell 3 fixed to and enclosing the insulative housing 1, a plurality of cables 23 and an inner circuit board 4 bridging the contacts 2 and the cables 23.

Referring to FIGS. 3 to 6, the insulative housing 1 includes a base portion 10 and a first tongue 11 and a second tongue 12 extending forwardly from the base portion 10. The first tongue 11 and the second tongue 12 are separated from each other by a gap 13 therebetween. The second tongue 12 is narrower than the first tongue 11. Both the first tongue 11 and the second tongue 12 define a plurality of passageways 14 for receiving the contacts 2. The base portion 10 includes a top block 15 and a first bottom block 161, a second bottom block 162 and a third bottom block 163 opposite to the top block 15. The third bottom block 163 is located between the first bottom block 161 and the second bottom block 162. In assembling, the inner circuit board 4 is sandwiched by the top block 15 and the first, the second and the third bottom blocks 161, 162 and 163 for positioning among which the first, the second and the third bottom blocks 161, 162 and 163 are adapted for supporting the inner circuit board 4, and the top block 15 is adapted for pressing the inner circuit board 4. Besides, the third bottom block 163 is located under the top block 15 so as to jointly form a slot 164 to partly receive the inner circuit board 4.

Figure 4:
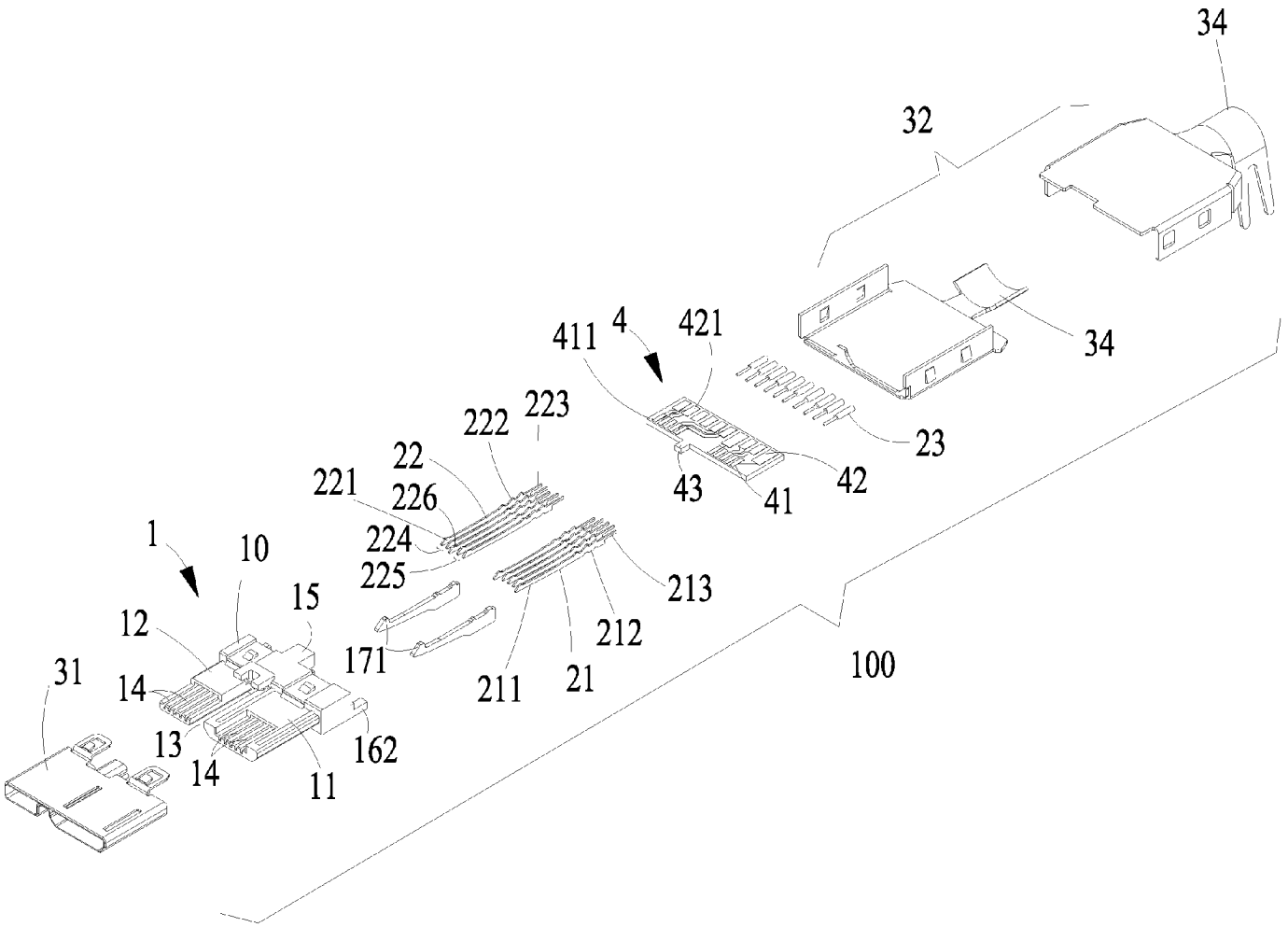
FIG. 4 is an exploded view of the cable connector as shown in FIG. 1.
Figure 5:
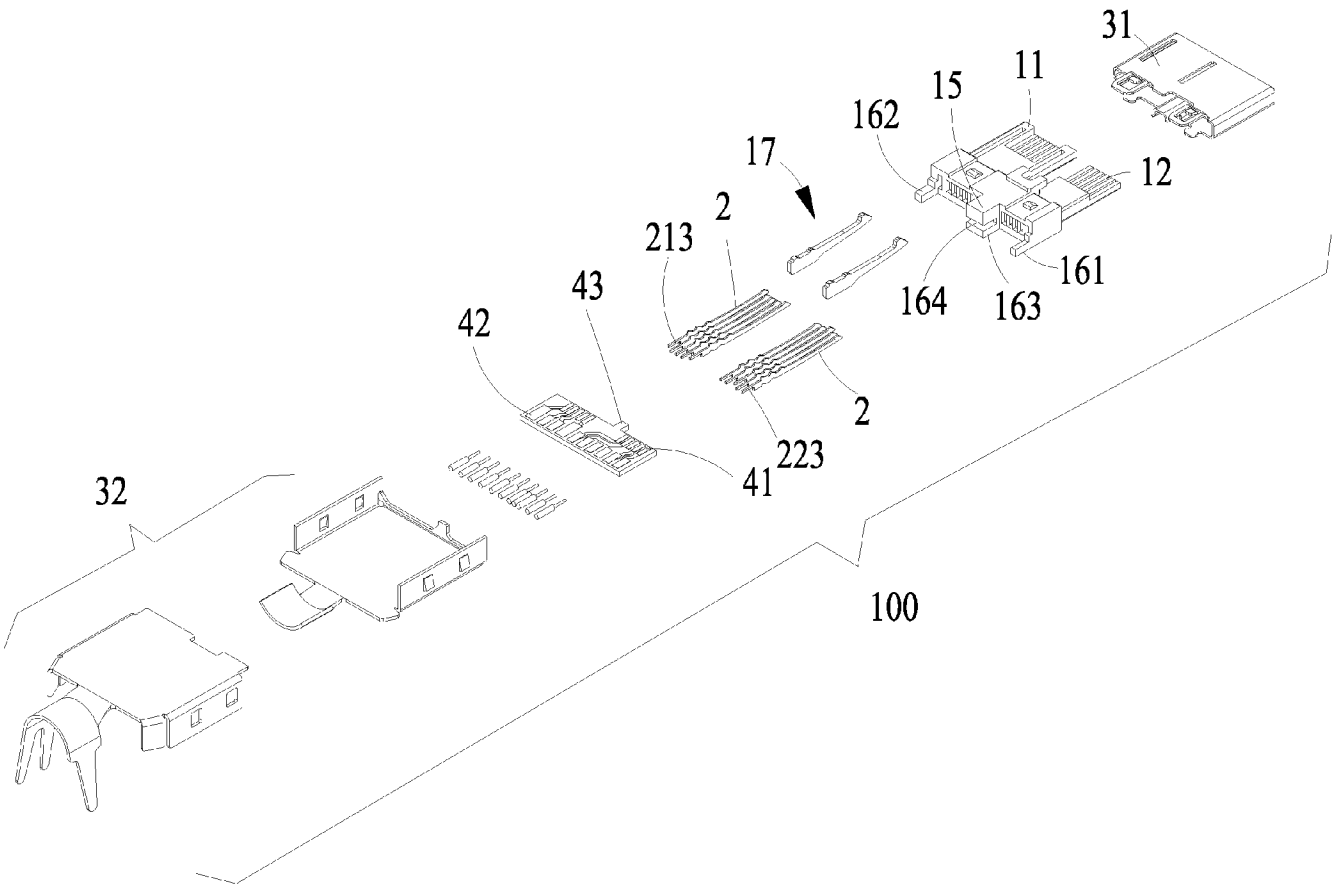
FIG. 5 is another exploded view of the cable connector as shown in FIG. 4, while taken from a different aspect.
Figure 6:
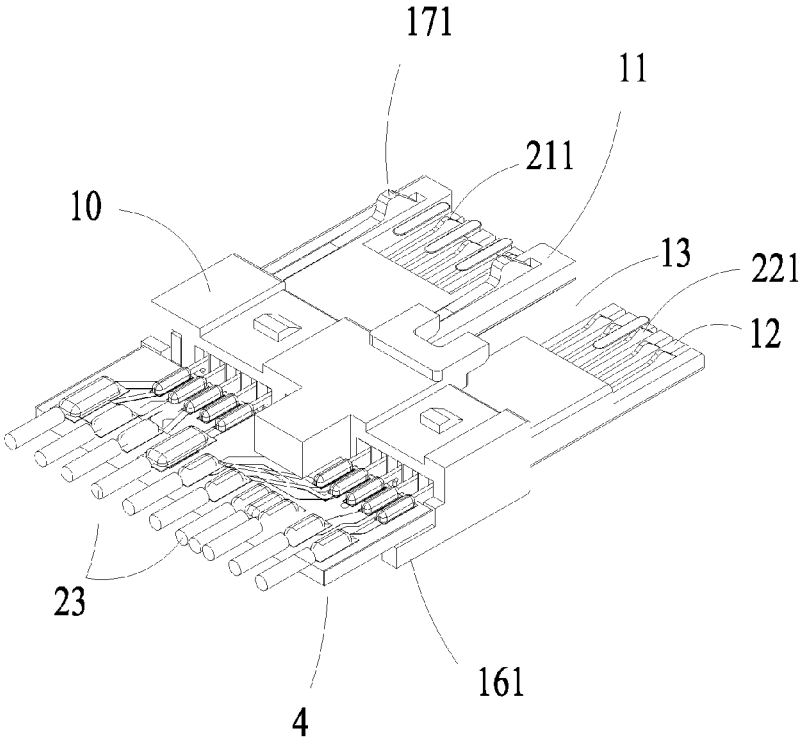
FIG. 6 is a partly exploded view of the cable connector as shown in FIG. 2 further with a front shell removed therefrom.

Referring to FIGS. 4 to 6, the contacts 2 are divided into a first contact group fixed to the first tongue 11 and a second contact group fixed to the second tongue 12. The first contact group includes four first contacts 21 compatible to Micro USB 2.0 standard. Each first contact 21 includes a first contacting section 211 extending upwardly beyond the first tongue 11, a first retaining section 212 fixed in the passageway 14 of the insulative housing 1 and a first soldering section 213 extending from the first retaining section 212 to be soldered to the inner circuit board 4.

Referring to FIGS. 4 to 6, the second contact group includes five second contacts 22. The first contacts 21 and the second contacts 22 jointly are compatible to Micro USB 3.0 standard. From a structural viewpoint, each second contact 22 includes a second contacting section 221 extending upwardly beyond the second tongue 12, a second retaining section 222 fixed in the passageway 14 of the insulative housing 1 and a second soldering section 223 to be soldered to the inner circuit board 4. From a functional viewpoint, the second contacts 22 includes a first pair of high-speed differential signal contacts 224, a second pair of high-speed differential signal contacts 225 and a grounding contact 226 disposed between the first pair and the second pair of high-speed differential signal contacts 224, 225. As shown in FIG. 5, rear ends of the first retaining sections 212 and the second retaining sections 222 are in alignment with each other to resist against a front end of the inner circuit board 4. Under such arrangement, on one hand, the inner circuit board 4 can be stopped by the first retaining sections 212 and the second retaining sections 222 so as to avoid over-insertion; on the other hand, the inner circuit board 4 is capable of preventing the contacts 2 from withdrawing from the passageways 14.

As shown in FIGS. 2 to 6, the inner circuit board 4 includes a first soldering area 41 and a second soldering area 42 opposite to the first soldering area 41. The first soldering area 41 is provided with a plurality of separated first pads 411 electrically and mechanically connected to the first soldering sections 213 and the second soldering sections 223 of the contacts 2. The second soldering area 42 is provided with a plurality of separated second pads 421 for being connected to the cables 23. As a result, through the inner circuit board 4, electrical connections between the contacts 2 and the cables 23 are established. Numbers of the first pads 411 and the second pads 421 are both ten. However, in order to meet the requirement of Micro USB 3.0 standard, nine of the first pads 411 are selected to electrically connect the second pads 421 for stable signal transmission. Only one of the first pads 411 does not establish any electrical connection with any of the second pads 421.

The first pads 411 are arranged in a first line. The second pads 421 are arranged in a second line parallel to the first line. The first pads 411 and the second pads 421 are positioned on a same surface of the inner circuit board 4. As a result, the first and the second soldering sections 213, 223 and the cables 23 can be easily and simultaneously soldered to the inner circuit board 4 for improving assembling efficiency. Besides, the cables 23 can avoid to be warped. The second soldering area 42 occupies a width much larger than the first soldering area 41 along a width direction of the inner circuit board 4. The inner circuit board 4 further includes a protrusion 43 extending forwardly beyond the first soldering area 41 to be received in the slot 164 of the insulative housing 1.

The metallic shell 3 includes a front shell 31 enclosing the first tongue 11 and the second tongue 12, and a rear shell 32 enclosing the base portion 10. According to the illustrated embodiment of the present invention, the rear shell 32 has two parts combined together. Each part includes a clip 34 for regulating the cables 23.

In order to realize stable locking, when the cable connector 100 is inserted into a mateable receptacle connector (not shown), a pair of latch arms 17 are employed and fixed in the insulative housing 1. Each latch arm 17 includes a hook 171 extending upwardly through the front shell 31.

Figure 7:
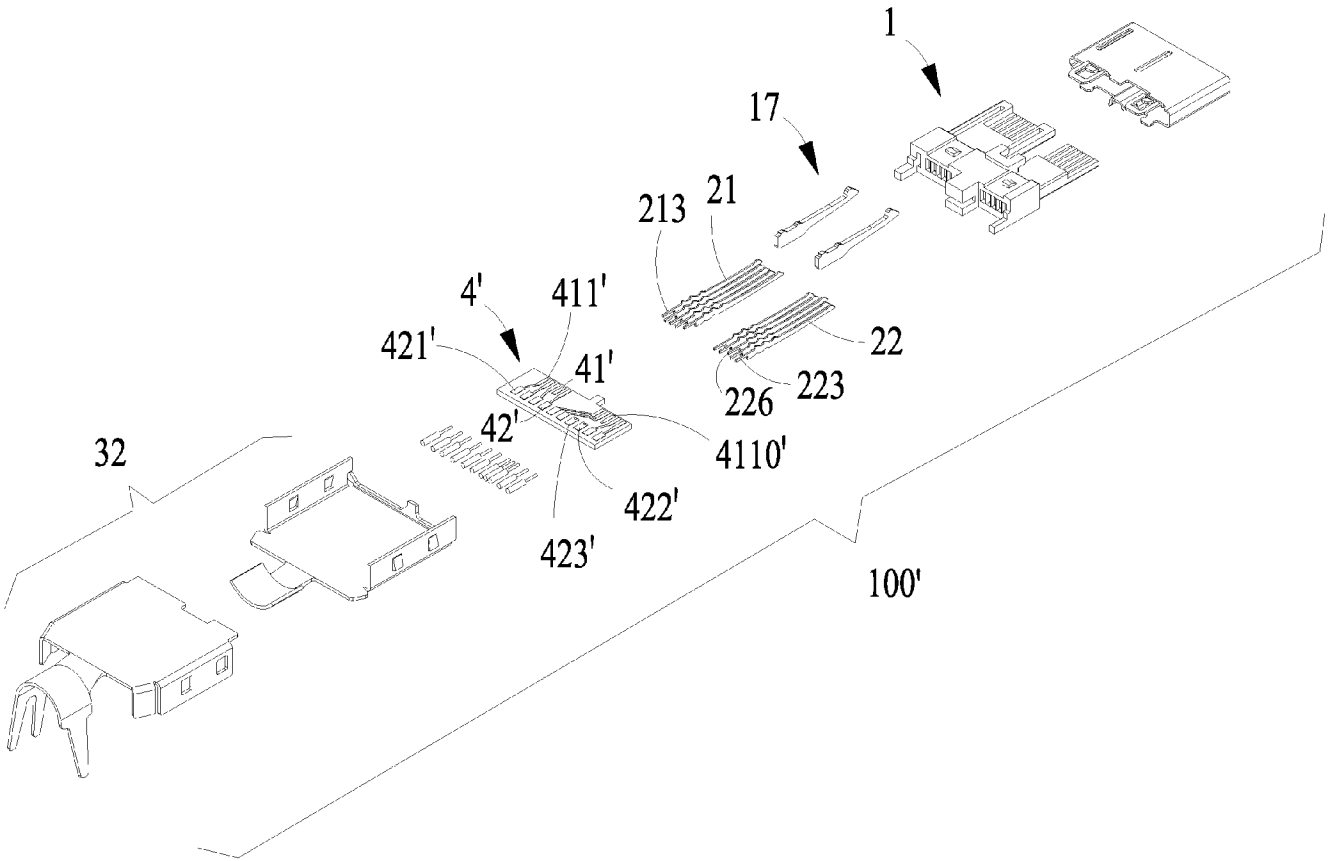
FIG. 7 is an exploded view of a cable connector in accordance with a second illustrated embodiment of the present invention.

Referring to FIG. 7, a second illustrated embodiment of the present invention discloses another cable connector 100' which is similar to the cable connector 100 of the first embodiment. The difference therebetween is the pad arrangement of the inner circuit board. In detail, the cable connector 100' includes an inner circuit board 4' which includes a first soldering area 41' and a second soldering area 42' opposite to the first soldering area 41'. The first soldering area 41' is provided with ten separated first pads 411' electrically and mechanically connected to the first soldering sections 213 and the second soldering sections 223 of the contacts 2. The second soldering area 42' is provided with ten separated second pads 421' for being connected to the cables 23. In order to meet the requirement of Micro USB 3.0 standard, nine of the first pads 411' are selected to electrically connect the second pads 421'. Only one of the first pads 411' does not establish any electrical connection with any of the second pads 421'. The first pads 411' include a first grounding pad 4110' connected to the second soldering section 223 of the grounding contact 226. Besides, as shown in FIG. 7, at least two adjacent second pads 422', 423' are electrically connected to the first grounding pad. Understandably, the two adjacent second pads 422', 423' are also grounding pads. With neighboring second pads 422', 423' both electrically connected to the first grounding pad 4110', high frequency characteristics of signal transmission can be greatly improved.

Figure 8:
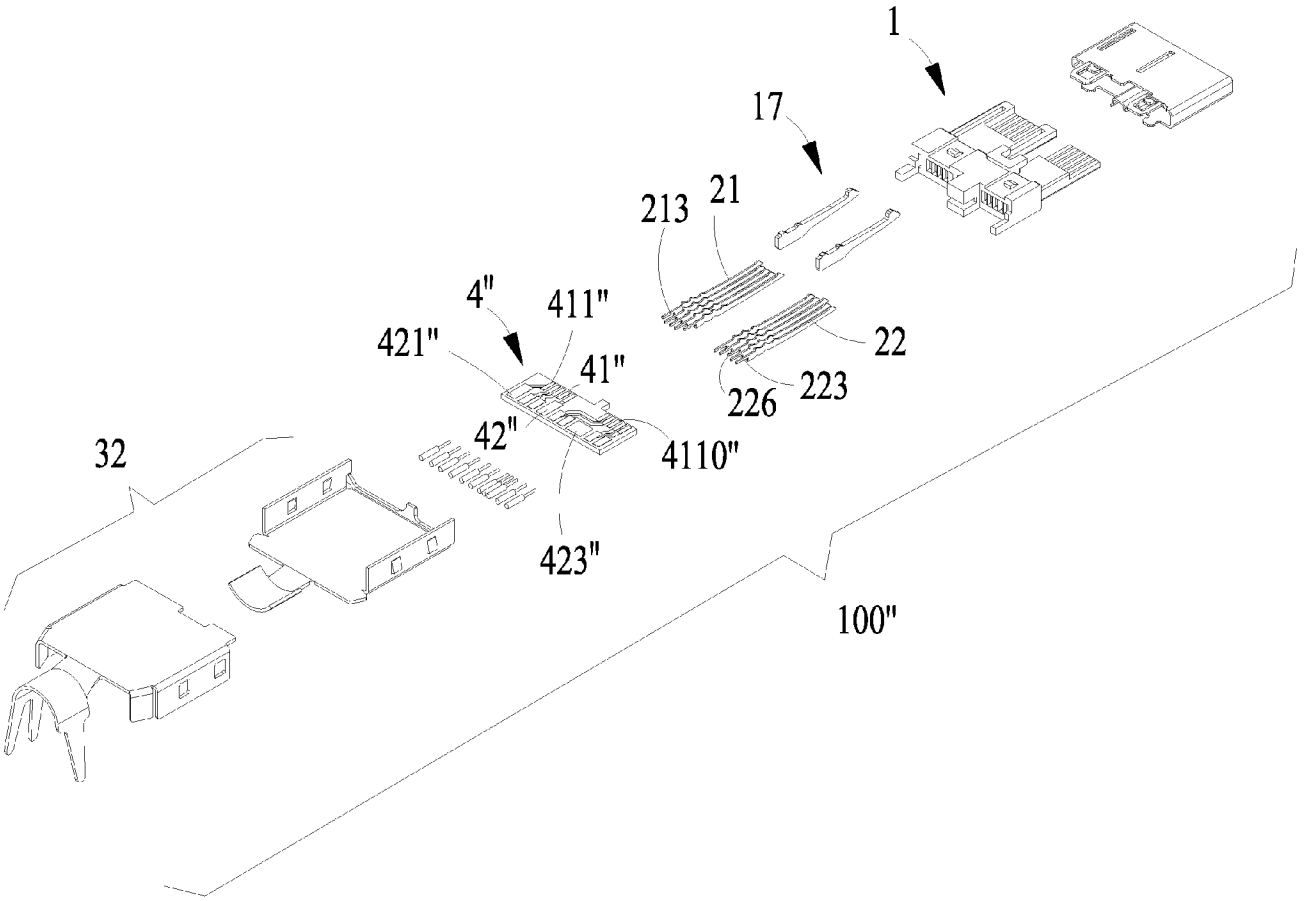
FIG. 8 is an exploded view of a cable connector in accordance with a third illustrated embodiment of the present invention.
Figure 9:
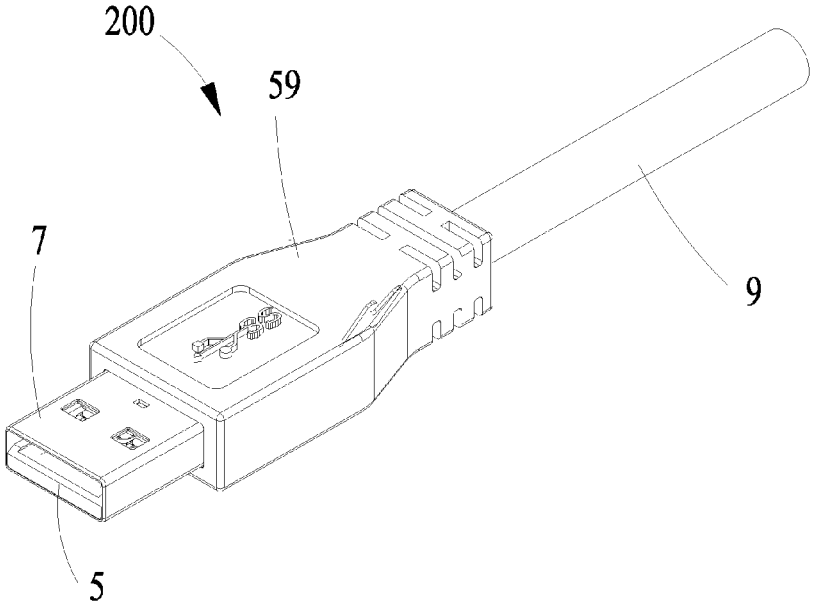
FIG. 9 is a perspective view of a cable connector in accordance with a fourth illustrated embodiment of the present invention.

Referring to FIG. 8, a third illustrated embodiment of the present invention discloses another cable connector 100" which is similar to the cable connector 100' of the second embodiment. The difference therebetween is the pad arrangement of the inner circuit board as well. In detail, the cable connector 100" includes an inner circuit board 4" which includes a first soldering area 41" and a second soldering area 42" opposite to the first soldering area 41". The first soldering area 41" is provided with ten separated first pads 411' electrically and mechanically connected to the first soldering sections 213 and the second soldering sections 223 of the contacts 2. The second soldering area 42" is provided with nine separated second pads 421" for being connected to the cables 23. In order to meet the requirement of Micro USB 3.0 standard, nine of the first pads 411" are selected to electrically connect the second pads 421". Only one of the first pads 411" does not establish any electrical connection with any of the second pads 421". The first pads 411" include a first grounding pad 4110" connected to the second soldering section 223 of the grounding contact 226. Besides, as shown in FIG. 8, the second pads 421" comprise a unitary second grounding pad 423" electrically connected to the first grounding pad 4110" and the second grounding pad 423" is much wider than its adjacent second pads 421". Preferably, the second grounding pad 423" is at least twice as wide as its adjacent second pads 421". As a result, high frequency characteristics of signal transmission can be greatly improved.

Referring to FIGS. 9 to 16, a fourth illustrated embodiment of the present invention disclose another cable connector 200 compatible to type-A USB 3.0 standard. The cable connector 200 and includes an insulative housing 5, a plurality of contacts 6 retained in the insulative housing 5, a metallic shell 7 fixed to and enclosing the insulative housing 5, a plurality of cables 9, an inner circuit board 8 bridging the contacts 6 and the cables 9, and an over-mold grasp portion 59 surrounding the insulative housing 5 and the metallic shell 7.

Referring to FIGS. 10 to 15, the insulative housing 5 includes a tongue plate 51 and an insulative block 52 attached to the tongue plate 51. The tongue plate 51 comprises a front mating portion 53 for mating with a mateable receptacle connector (not shown) and a rear base portion 54 extending backwardly from the mating portion 53. The mating portion 53 is rectangular shaped and includes a top mating surface 531, a bottom surface 532 opposite to the mating surface 531 and a plurality of slots 533 extending upwardly through the mating surface 531. The base portion 54 includes a rectangular recess 541, a pair of round holes 542 formed in the recess 541, a pair of notches 543 on lateral edges thereof and a pair of stepped walls 544 exposed to the notches 543. Besides, the base portion 54 includes a bottom protrusion 545 extending rearwardly.

The insulative block 52 includes a main body 521 and a top protrusion 522 extending backwardly from the main body 521. The main body 521 includes a rectangular protrusion 523 with a pair of cylinder posts 524 thereon, and a pair of locking arms 525 each of which includes a hook 526 at a distal end thereof. In assembling, the inner circuit board 8 is sandwiched between the top protrusion 522 and the bottom protrusion 545. The top protrusion 522 and the bottom protrusion 545 cooperatively form a receiving slot 546 to receive at least a front side of the inner circuit board 8.

Figure 10:
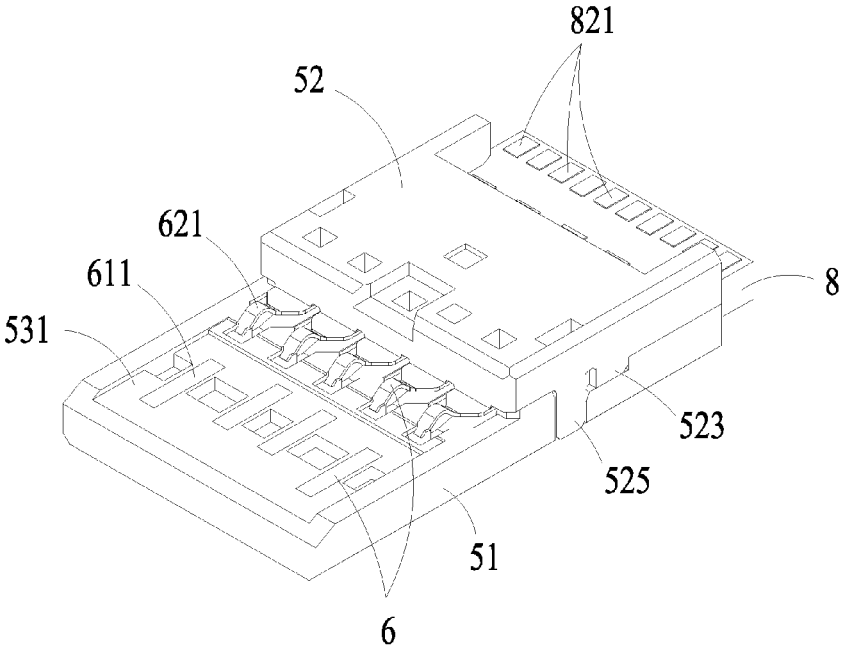
FIG. 10 is a partly exploded view of the cable connector as shown in FIG. 9 with a metallic shell, an over-mold grasp portion and cables removed therefrom.
Figure 11:
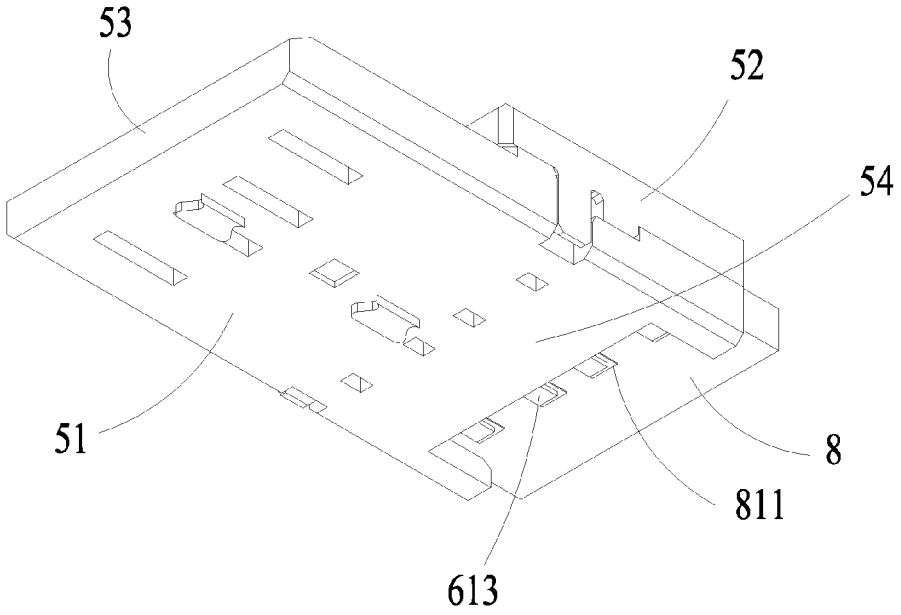
FIG. 11 is another partly exploded view of the cable connector as shown in FIG. 10 while taken from a different aspect.
Figure 12:
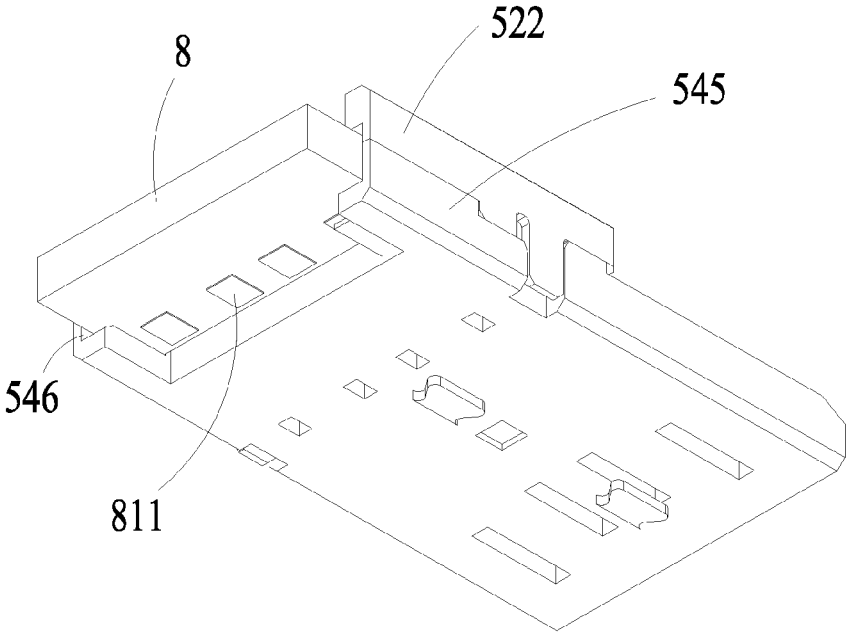
FIG. 12 is another partly exploded view of the cable connector as shown in FIG. 11 while taken from a different aspect.
Figure 13:
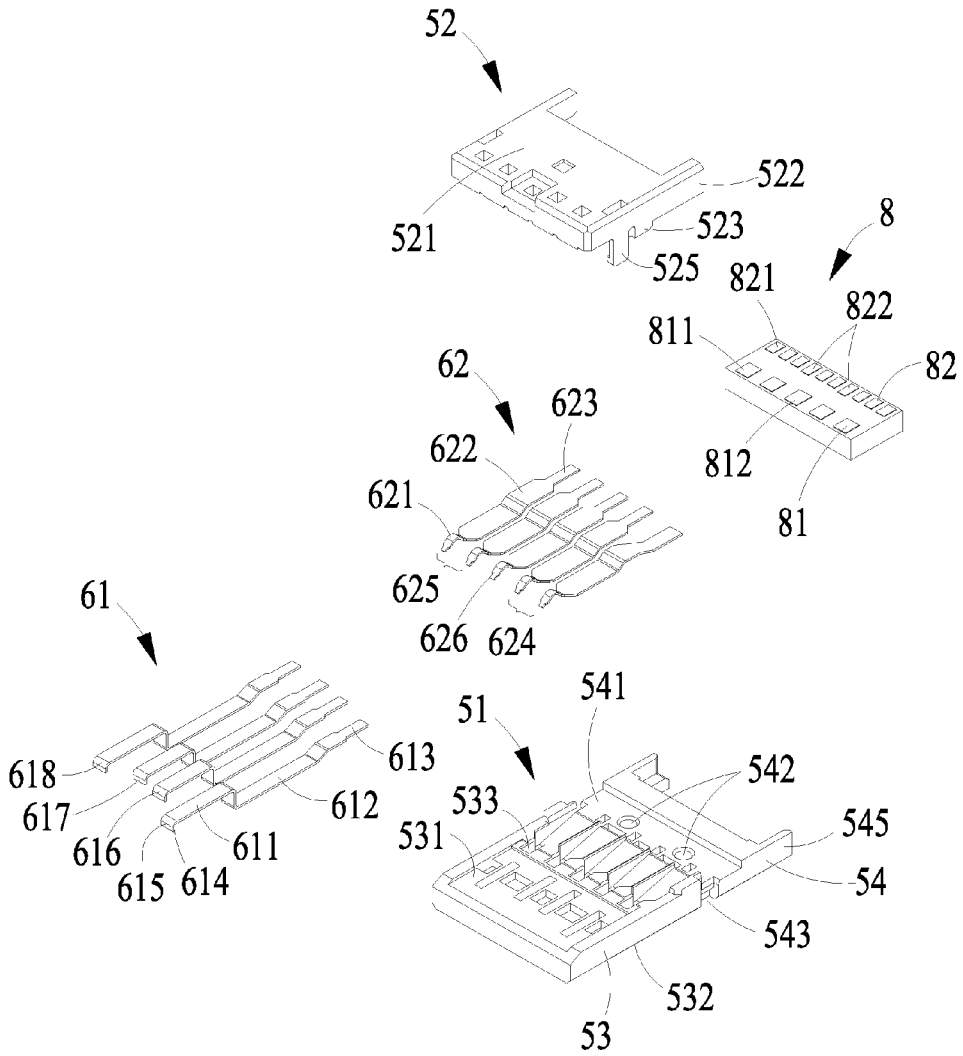
FIG. 13 is an exploded view of the cable connector as shown in FIG. 10.
Figure 14:
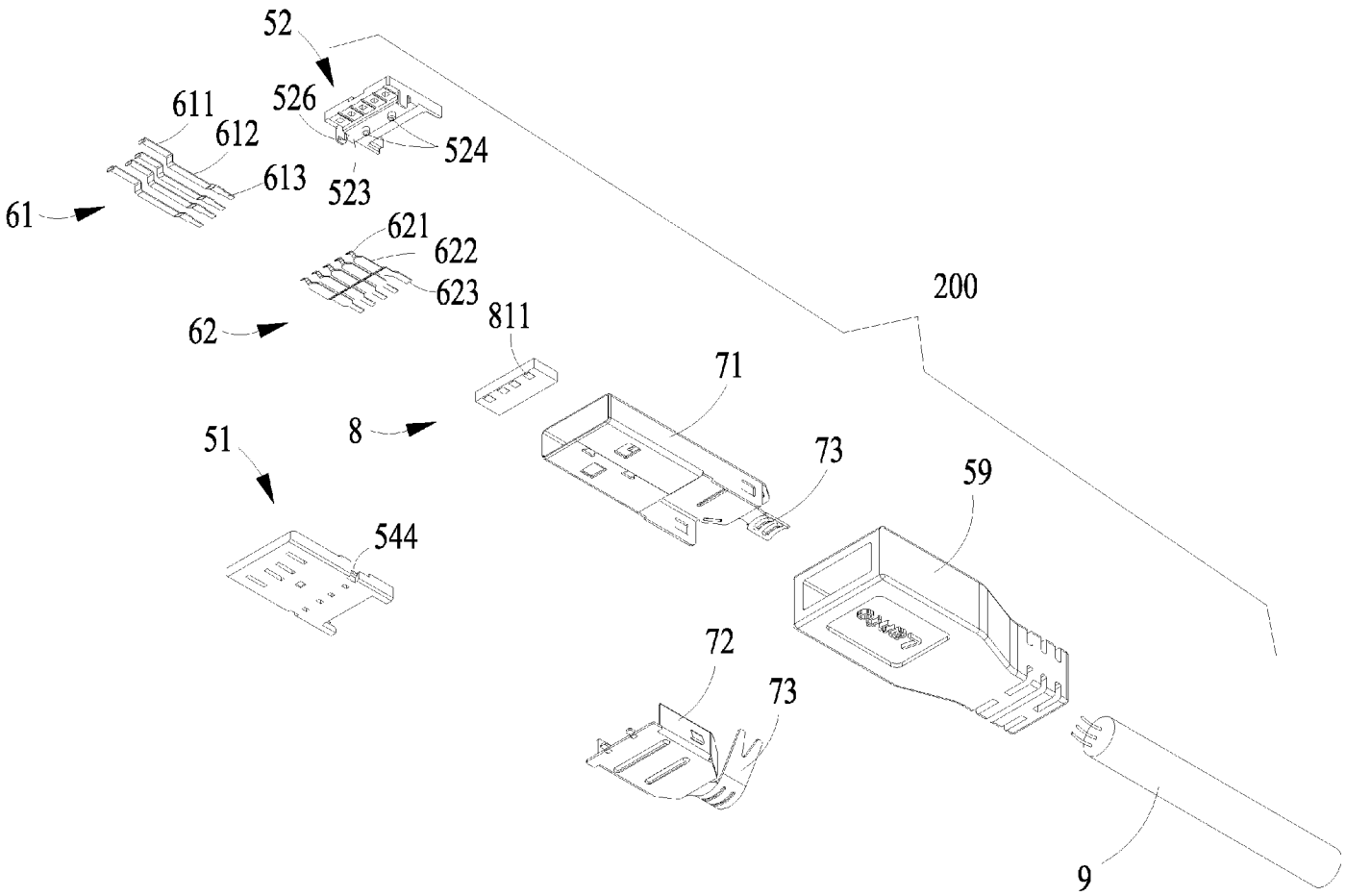
FIG. 14 is another exploded view of the cable connector as shown in FIG. 13 while taken from a different aspect.

Referring to FIGS. 10 to 15, the contacts 6 are divided into a first contact group and a second contact group. The first contact group includes a plurality of first contacts 61 compatible to USB 2.0 standard. From a structural viewpoint, each first contact 61 includes a flat/non-elastic first contacting section 611 extending onto the mating surface 531 of the mating portion 53 (as shown in FIG. 10), a first retaining section 612 fixed in the tongue plate 51 of the insulative housing 5 and a first soldering section 613 for being soldered to the inner circuit board 8. According to the illustrated embodiment of the present invention, the first contacts 61 are insert-molded with the tongue plate 51. The first retaining sections 612 are lower than the first contacting sections 611 and the first soldering sections 613 so that, on one hand, the first retaining sections 612 can be more stably embedded in the tongue plate 51; on the other hand, the first contacting sections 611 can be exposed on the mating surface 531 for mating with the mateable receptacle connector and the first soldering sections 613 can be exposed for being soldered to the inner circuit board 8. Besides, each first contact 61 includes a front tab 614 bent downwardly from a front edge of the first contacting section 611. The front tabs 614 are embedded in the mating portion 53 for not only securely retaining the first contacting sections 611 onto the mating surface 531 of the mating portion 53 but also preventing the first contacting sections 611 from upwardly buckling during insertion into the mateable receptacle connector. From a functional viewpoint, the first contacts 61 include a power contact 615, a first signal contact 616, a second signal contact 617 and a first grounding contact 618.

Referring to FIGS. 10 to 15, the second contact group includes a plurality of second contacts 62. The first contacts 61 and the second contacts 62 jointly are compatible to USB 3.0 standard. From a structural viewpoint, each second contact 62 includes a resilient/deformable second contacting section 621, a second retaining section 622 fixed in the insulative block 52 of the insulative housing 5 and a second soldering section 623 for being soldered to the inner circuit board 8. From a functional viewpoint, the second contacts 62 includes a first pair of high-speed differential signal contacts 624, a second pair of high-speed differential signal contacts 625 and a grounding contact 626 disposed between the first pair and the second pair of high-speed differential signal contacts 624, 625.

As shown in FIG. 10, the resilient second contacting sections 621 protrude upwardly beyond the first contacting sections 611 and the mating surface 531 of the mating portion 53, and can be deformable in corresponding slots 533 during connector mating. The first contacting sections 611 are positioned at the front of the resilient second contacting sections 621. According to the illustrated embodiment of the present invention, the second contacts 62 are insert-molded with the insulative block 52 to be a contact module. The first soldering sections 613 and the second soldering sections 623 are located at different horizontal planes, respectively for easy arrangement.

As shown in FIGS. 10 to 16, the inner circuit board 8 includes a first soldering area 81 and a second soldering area 82 opposite to the first soldering area 81. The first soldering area 81 is provided with five separated first pads 811 on a top surface thereof for being electrically and mechanically connected to the second soldering sections 623 of the second contacts 62, and another four separated first pads 811 on a bottom surface thereof for being electrically and mechanically connected to the first soldering sections 613 of the first contacts 61. The second soldering area 82 is provided with ten separated second pads 821 for being connected to the cables 9. The second pads 821 are arranged in a line as a result that the second pads 821 can be easily and simultaneously soldered to cables 9 for improving assembling efficiency. Besides, the cables 9 can avoid to be warped. As a result, through the inner circuit board 8, electrical connections between the contacts 6 and the cables 9 are established.

Figure 16:
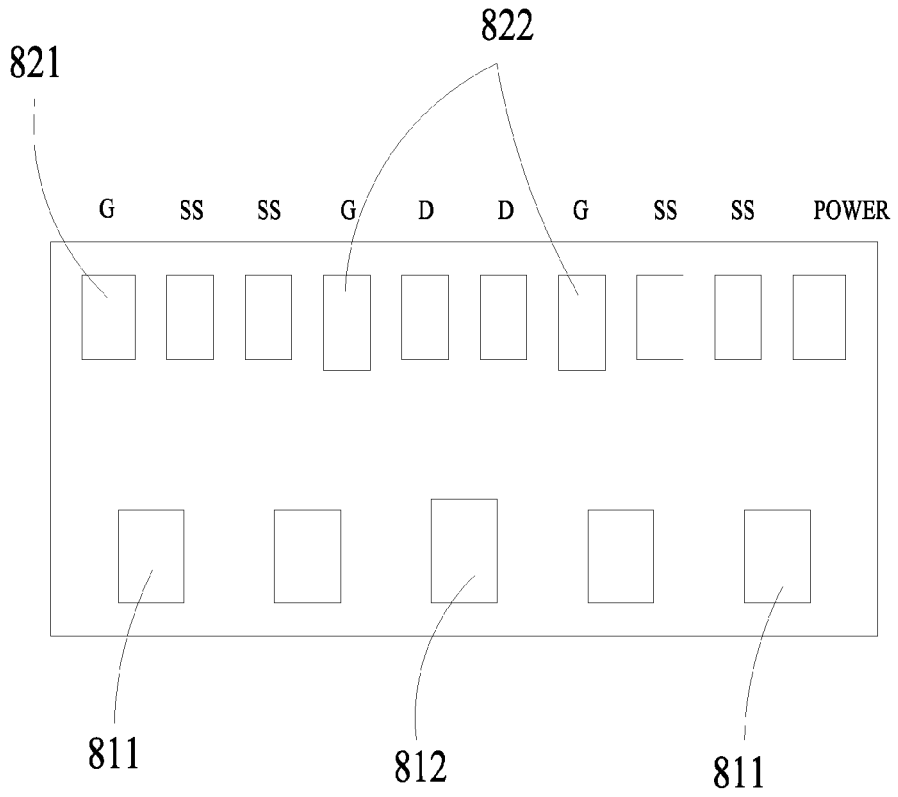
FIG. 16 is a top view of an inner circuit board of the cable connector.

The first pads 811 include a first grounding pad 812 connected to the second soldering section 623 of the second grounding contact 626. The second pads 821 include at least two second grounding pads 822 separated from each other in physical location while both electrically connected to the first grounding pad 812 in electrical property. As shown in FIG. 16, the second pads 822 are arranged to be electrically connected to the contacts 6 in turn as follows along a width direction of the insulative housing: the power contact 615, the first pair of high-speed differential signal contacts 624, the second grounding contact 626, the first signal contact 616, the second signal contact 617, the second grounding contact 626, the second pair of high-speed differential signal contacts 625, and the first grounding contact 618.

Figure 15:
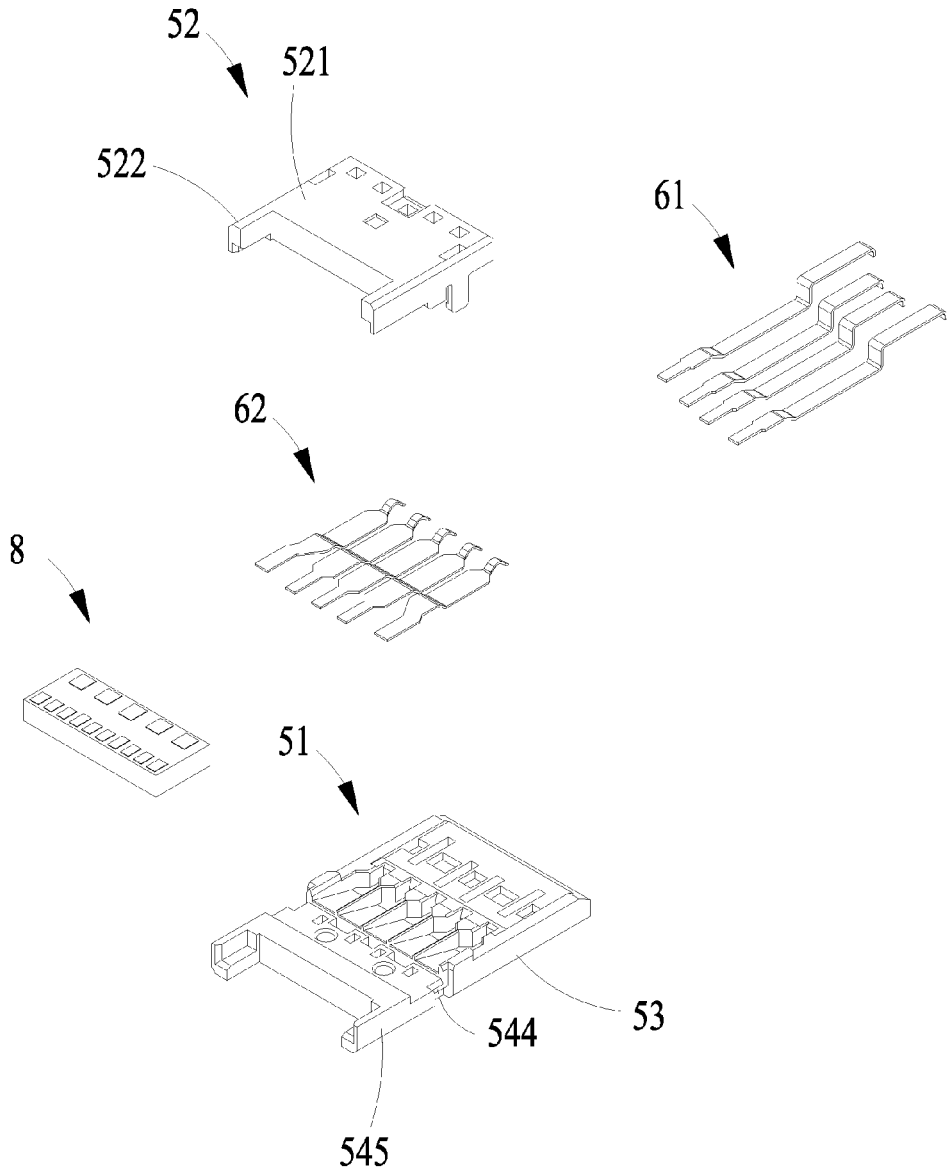
FIG. 15 is a wholly exploded view of the cable connector as shown in FIG. 1.

Referring to FIG. 15, the metallic shell 7 encloses the mating portion 53 and includes a top shell 71 and a bottom shell 72 locking with the top shell 71. Each of the top shell 71 and the bottom shell 72 includes a clip 73 for regulating/fixing the cables 9.

In assembling, the tongue plate 51 with the first contacts 61 and the insulative block 52 with the second contacts 62 are attached with each other. The protrusion 523 of the insulative block 52 is received in the recess 541 of the tongue plate 51. The pair of cylinder posts 524 are inserted in the pair of round holes 542 for positioning. The pair of locking arms 525 are mateable with the notches 543 a top-to-bottom direction with the hooks 526 lockable with corresponding stepped walls 544 for preventing the insulative block 52 from being separated from the tongue plate 51 along a bottom-to-top direction. Then, the inner circuit board 8 is inserted into the receiving slot 546. Then, the top shell 71 and the bottom shell 72 are assembled to the insulative housing 1. After that, soldering processes are adopted to solder the first and the second soldering sections 613, 623 with the first pads 811, and to solder the second pads 821 with the cables 9. Ultimately, the overmold grasp portion 59 is ejected to surround the insulative housing 5 and the metallic shell 7.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A cable connector compatible to Micro Universal Serial Bus (USB) 3.0 standard, comprising:

an insulative housing comprising a first tongue and a second tongue narrower than the first tongue;

a plurality of contacts retained in the insulative housing and divided into a first contact group fixed to the first tongue and a second contact group fixed to the second tongue, the first contact group comprising a plurality of first contacts each of which comprises a first contacting section extending beyond the first tongue, a first retaining section fixed in the insulative housing and a first soldering section extending from the first retaining section; the second contact group comprising a plurality of second contacts each of which comprises a second contacting section protruding upwardly beyond the second tongue, a second retaining section fixed in the insulative housing and a second soldering section extending from the second retaining section, the second contacts comprising a first pair of high-speed differential signal contacts, a second pair of high-speed differential signal contacts and a grounding contact disposed between the first pair and the second pair of high-speed differential signal contacts;

an inner circuit board comprising a first soldering area and a second soldering area opposite to the first soldering area, the first soldering area comprising a plurality of separated first pads electrically and mechanically connected to the first soldering sections and the second soldering sections, the first pads comprising a first grounding pad connected to the second soldering section of the grounding contact; the second soldering area comprising a plurality of separated second pads for being connected to cables so as to establish electrical connections between the contacts and the cables; and a metallic shell enclosing the insulative housing; wherein at least two adjacent second pads are electrically connected to the first grounding pad.

2. The cable connector as claimed in claim 1, wherein the first pads are arranged in a first line, the second pads are arranged in a second line parallel to the first line, and the first pads and the second pads are positioned on a same surface of the inner circuit board.

3. The cable connector as claimed in claim 1, wherein numbers of the first pads and the second pads are both ten while only one of the first pads does not establish any electrical connection with any of the second pads.

4. The cable connector as claimed in claim 1, wherein the second soldering area occupies a width much larger than the first soldering area along a width direction of the inner circuit board.

5. The cable connector as claimed in claim 1, wherein the insulative housing comprises a base portion from which the first tongue and the second tongue extend, the base portion comprising at least one top block and at least one bottom block to sandwich the inner circuit board therebetween for positioning.

6. The cable connector as claimed in claim 5, wherein the base portion comprises a first bottom block, a second bottom block and a third bottom block located between the first bottom block and the second bottom block, the third bottom block being located under the at least one top block so as to jointly form a slot to partly receive the inner circuit board.

7. The cable connector as claimed in claim 6, wherein the inner circuit board comprises a protrusion extending forwardly beyond the first soldering area, the protrusion being received in the slot.

8. The cable connector as claimed in claim 6, wherein rear ends of the first retaining sections and the second retaining sections are in alignment with each other to resist against a front end of the inner circuit board.

9. A cable connector compatible to Micro Universal Serial Bus (USB) 3.0 standard, comprising:

an insulative housing comprising a first tongue and a second tongue narrower than the first tongue;

a plurality of contacts retained in the insulative housing and divided into a first contact group fixed to the first tongue and a second contact group fixed to the second tongue, the first contact group comprising a plurality of first contacts each of which comprises a first contacting section extending beyond the first tongue, a first retaining section fixed in the insulative housing and a first soldering section extending from the first retaining section; the second contact group comprising a plurality of second contacts each of which comprises a second contacting section protruding upwardly beyond the second tongue, a second retaining section fixed in the insulative housing and a second soldering section extending from the second retaining section, the second contacts comprising a first pair of high-speed differential signal contacts, a second pair of high-speed differential signal contacts and a grounding contact disposed between the first pair and the second pair of high-speed differential signal contacts;

an inner circuit board comprising a first soldering area and a second soldering area opposite to the first soldering area, the first soldering area comprising a plurality of separated first pads electrically and mechanically connected to the first soldering sections and the second soldering sections, the first pads comprising a first grounding pad connected to the second soldering section of the grounding contact; the second soldering area comprising a plurality of separated second pads for being connected to cables so as to establish electrical connections between the contacts and the cables; and a metallic shell enclosing the insulative housing; wherein the second pads comprise a unitary second grounding pad electrically connected to the first grounding pad and the second grounding pad is much wider than its adjacent second pads.

10. The cable connector as claimed in claim 9, wherein the first pads are arranged in a first line, the second pads are arranged in a second line parallel to the first line, and the first pads and the second pads are positioned on a same surface of the inner circuit board.

11. The cable connector as claimed in claim 9, wherein a number of the first pads is ten, a number of the second pads is nine, the second soldering area occupies a width much larger than the first soldering area along a width direction of the inner circuit board, and only one of the first pads does not establish any electrical connection with any of the second pads.

12. The cable connector as claimed in claim 9, wherein the insulative housing comprises a base portion from which the first tongue and the second tongue extend, the base portion comprising at least one top block and at least one bottom block to sandwich the inner circuit board therebetween for positioning.

13. The cable connector as claimed in claim 12, wherein the base portion comprises a first bottom block, a second bottom block and a third bottom block located between the first bottom block and the second bottom block, the third bottom block being located under the at least one top block so as to jointly form a slot to partly receive the inner circuit board, the inner circuit board further comprising a protrusion extending forwardly beyond the first soldering area to be received in the slot.

14. The cable connector as claimed in claim 9, wherein the second grounding pad is at least twice as wide as its adjacent second pads.

15. A cable connector compatible to type-A Universal Serial Bus (USB) 3.0 standard, comprising:

an insulative housing comprising a tongue plate defining a mating portion;

a plurality of contacts retained in the insulative housing and divided into a first contact group and a second contact group, the first contact group comprising a plurality of first contacts each of which comprises a flat first contacting section extending onto the mating portion, a first retaining section fixed in the insulative housing and a first soldering section extending from the first retaining section, the first contacts comprising a power contact, a first signal contact, a second signal contact and a first grounding contact; the second contact group comprising a plurality of second contacts each of which comprises a resilient second contacting section protruding upwardly beyond the first contacting sections, a second retaining section fixed in the insulative housing and a second soldering section extending from the second retaining section, the second contacts comprising a first pair of high-speed differential signal contacts, a second pair of high-speed differential signal contacts and a second grounding contact disposed between the first pair and the second pair of high-speed differential signal contacts; and an inner circuit board comprising a first soldering area and a second soldering area opposite to the first soldering area, the first soldering area comprising a plurality of separated first pads electrically and mechanically connected to the first soldering sections and the second soldering sections, the first pads comprising a first grounding pad connected to the second soldering section of the second grounding contact; the second soldering area comprising a plurality of separated second pads for being connected to cables so as to establish electrical connections between the contacts and the cables; wherein the second pads comprise at least two second grounding pads separated from each other in physical location while both electrically connected to the first grounding pad in electrical property.

16. The cable connector as claimed in claim 15, wherein the first soldering sections and the second soldering sections are located at different horizontal planes, respectively, and the first pads and the second pads are positioned on opposite surfaces of the inner circuit board.

17. The cable connector as claimed in claim 15, wherein the second pads are arranged to be electrically connected to the contacts in turn as follows along a width direction of the insulative housing: the power contact, the first pair of high-speed differential signal contacts, the second grounding contact, the first signal contact, the second signal contact, the second grounding contact, the second pair of high-speed differential signal contacts, and the first grounding contact.

18. The cable connector as claimed in claim 15, wherein the first contacts are insert-molded with the tongue plate, the insulative housing comprising an insulative block with the second contacts embedded therein, the insulative block being locked with the tongue plate along a top-to-bottom direction, the tongue plate comprising a pair of notches on lateral edges thereof and a pair of stepped walls exposed to the notches, the insulative block comprising a pair of locking arms each of which comprises a hook to lock with corresponding stepped wall so as to prevent the insulative block from being separated from the tongue plate along a bottom-to-top direction.

19. The cable connector as claimed in claim 18, wherein the tongue plate defines a recess and a pair of holes in the recess, and the insulative block comprises a protrusion received in the recess and a pair of cylinder posts inserted in the holes for positioning.

20. The cable connector as claimed in claim 18, wherein the tongue plate comprises a bottom protrusion, the insulative block comprises a top protrusion, and the inner circuit board is sandwiched between the top protrusion and the bottom protrusion, the top protrusion and the bottom protrusion cooperatively forming a receiving slot to receive at least a front side of the inner circuit board.

* * * * *